US011814591B1

(12) United States Patent
Schmidt

(10) Patent No.: US 11,814,591 B1
(45) Date of Patent: Nov. 14, 2023

(54) RECOVERING GASEOUS HYDROCARBONS AS FUEL ON SITE

(71) Applicant: Energy and Environmental Research Center Foundation, Grand Forks, ND (US)

(72) Inventor: Darren Schmidt, Williston, ND (US)

(73) Assignee: Energy and Environmental Research Center Foundation, Grand Forks, ND (US)

( * ) Notice: Subject to any disclaimer, the term of this patent is extended or adjusted under 35 U.S.C. 154(b) by 0 days.

(21) Appl. No.: 18/171,019

(22) Filed: Feb. 17, 2023

Related U.S. Application Data

(63) Continuation-in-part of application No. 18/047,378, filed on Oct. 18, 2022, now Pat. No. 11,697,773, which is a continuation of application No. 17/811,016, filed on Jul. 6, 2022, now Pat. No. 11,505,750.

(51) Int. Cl.
*C10G 5/06* (2006.01)
*C10G 31/06* (2006.01)

(52) U.S. Cl.
CPC ..... *C10G 5/06* (2013.01); *C10G 2300/4012* (2013.01); *C10G 2400/28* (2013.01)

(58) Field of Classification Search
CPC .... C10G 5/06; C10G 31/06; C10G 2300/202; B01D 5/009
See application file for complete search history.

(56) References Cited

U.S. PATENT DOCUMENTS 7,833,317 B2 11/2010 Lund
9,758,735 B2 * 9/2017 Meyer ..... C10G 7/02
9,988,581 B2 6/2018 Meyer
10,017,701 B2 7/2018 Meyer
11,505,750 B1 11/2022 Schmidt
2008/0223796 A1 * 9/2008 Silva Valente ..... B01D 19/0052 210/512.3

FOREIGN PATENT DOCUMENTS

WO WO-2021262624 A2 12/2021

OTHER PUBLICATIONS

"U.S. Appl. No. 17/811,016, Notice of Allowance dated Sep. 7, 2022".
"Crude Oil Stabilization and Recovery", Aspen Engineering Services, LLC, [Online] Retrieved from the Internet: <URL: https://aspenesco.com/uploads/3/4/8/5/34851592/cosr_brochure_—_aspen.pdf>, (2018), 1 pg.
"U.S. Appl. No. 18/047,378, Notice of Allowance dated Mar. 29, 2023", 9 pgs.

* cited by examiner

*Primary Examiner* — Randy Boyer
(74) *Attorney, Agent, or Firm* — Schwegman Lundberg & Woessner, P.A.

(57) ABSTRACT

A method of recovering gaseous hydrocarbons from tank headspace as fuel on-site includes flowing a hydrocarbon gas composition from headspace of a tank fed by a secondary separator into a compressor to form a compressed mixture. The method includes flowing the compressed mixture into a cooling unit to cool the compressed mixture, to form a cooled composition including liquid hydrocarbons. The method includes flowing the cooled composition to a buffer tank to form a buffered fuel composition. The method includes removing a fuel gas composition from headspace of the buffer tank. The method also includes combusting the fuel gas composition as an on-site fuel.

20 Claims, 3 Drawing Sheets

RECOVERING GASEOUS HYDROCARBONS AS FUEL ON SITE

CROSS-REFERENCE TO RELATED APPLICATIONS

This application is a continuation-in-part of and claims the benefit of priority under 35 U.S.C. § 120 to U.S. Utility application Ser. No. 18/047,378 filed Oct. 18, 2022, which is a continuation of and claims priority to U.S. Utility application Ser. No. 17/811,016 filed Jul. 6, 2022 which is issued as U.S. Pat. No. 11,505,750, the disclosures of which are incorporated herein in their entirety by reference.

BACKGROUND

Hydrocarbon gases are almost always associated with crude oil in an oil reserve because they represent the lighter chemical fraction (shorter molecular chain) formed when organic remains are converted into hydrocarbons. Such hydrocarbon gases may exist separately from the crude oil in the underground formation or they may be dissolved in the crude oil. As the crude oil is extracted from the reservoir and raised to the surface, or subsequent to that process, the pressure in the crude oil is reduced and dissolved hydrocarbon gases come out of solution. Such gases occurring in combination with the crude oil are often referred to as "associated" gas.

At well pads where the production of oil and associated gas is of high volume and high pressure, so called high producing well pads, it is economical to use existing technologies to separate the associated gas from the oil to produce what may be called "sales" gas and to process the sales gas. The processing of the sales gas can produce pipeline-quality natural gas as well as purity products in the form of propane, butane, and gas condensate. The natural gas is introduced into a gas pipeline or a storage means for onward transmission and/or sale, and the purity products are generally sold and or stored separately. The sales gas generally includes around 50% methane ($CH_3$), 20% ethane ($C_2H_6$), 13% propane ($C_3H_8$), 5% butane ($C_4H_{10}$), and the balance is heaver hydrocarbons.

At well pads where the production of oil and associated gas is not of high volume or high pressure (so called low-producing well pads), it may not be economic to install and use existing technologies to process the sales gas in the same way that it is processed at high producing well pads. At such well pads, any gas that comes out of the oil may be treated as "flare" or "vent" gas.

Once the crude oil has been extracted from the ground, it is generally passed through a primary separator such as a two-phase separator with the intention of separating the sales gas from the oil. Thereafter the oil may undergo other processes, for example passing that oil through a secondary separator such as a heater treater apparatus and/or storage in a storage tank. Associated gases are given off by the oil during those other processes. Those gases are at low pressure and generally contain little to no methane, and the majority of the gas is a mixture of ethane, propane and butane. This gas may be called "rich gas" because it is rich in ethane, propane and butane (e.g., having less than 50 mole % methane). These gases are also often known as "flare" or "vent" gases. It is conventionally not economical to process this rich gas in the same fashion as the sales gas is processed.

Rich gas has historically been considered to be a by-product or waste product of oil production and this gas has been typically disposed of by venting or flaring (burning).

Venting and flaring are relatively inexpensive ways to deal with rich gas, but result in relatively high emissions (e.g., large quantities of greenhouse gases) and fail to capture any of the energy or value contained within the gas. Improved flaring systems and methods have been developed to reduce flare emissions sufficiently to satisfy stringent emission standards; however, many of these improved flaring systems merely convert the energy within the flare gas into thermal energy which releases to the environment. These improved flaring systems do not capture the energy contained within the flare gas, let alone recover the full value of the gas. Any flaring system will, in addition to its criteria pollutants, contribute to carbon dioxide emissions (carbon footprint) generated by the operator of the flare. There is ever-increasing pressure on oil field operators to reduce and minimize their carbon footprint.

Other gas recovery techniques such as fueling engines, producing natural gas liquids, conventional vapor recovery, or frac water heating have been used; however, these techniques have been found to rely on a large volume throughput in order to achieve attractive economics, are challenged with high maintenance costs, and/or are only useful for niche applications.

SUMMARY OF THE INVENTION

Various aspects of the present invention relate to hydrocarbon gas recovery methods and apparatuses, such as for the recovery of hydrocarbon gas that is emitted during the extraction and treatment of crude oil which would otherwise be vented or flared (i.e., lost).

Various aspects of the present invention provide a method of recovering gaseous hydrocarbons from tank headspace as fuel on-site. The method includes flowing a hydrocarbon gas composition from headspace of a tank fed by a secondary separator into a compressor to form a compressed mixture. The secondary separator accepts a crude liquid hydrocarbon input stream from a primary separator. The primary separator includes a crude hydrocarbon input stream and includes an output stream including the crude liquid hydrocarbon stream that is inputted to the secondary separator. The method includes flowing the compressed mixture into a cooling unit to cool the compressed mixture, to form a cooled composition including liquid hydrocarbons. The method includes flowing the cooled composition to a buffer tank to form a buffered fuel composition. The method includes removing a fuel gas composition from headspace of the buffer tank. The method also includes combusting the fuel gas composition as an on-site fuel.

Various aspects of the present invention provide a method of recovering gaseous hydrocarbons from tank headspace as fuel on-site. The method includes flowing a hydrocarbon gas composition from headspace of a tank fed by a separator into a compressor to form a compressed mixture, wherein the separator accepts a crude hydrocarbon input stream and outputs a crude liquid hydrocarbon stream to the tank. The method includes flowing the compressed mixture into a cooling unit to cool the compressed mixture, to form a cooled composition comprising liquid hydrocarbons. The method includes flowing the cooled composition to a buffer tank to form a buffered fuel composition. The method includes removing a fuel gas composition from headspace of the buffer tank. The method also includes combusting the fuel gas composition as an on-site fuel.

Various aspects of the present invention provide a method of recovering gaseous hydrocarbons from tank headspace. The method includes flowing a hydrocarbon gas composition from headspace of a tank fed by a heater-treater into a compressor to form a compressed mixture. The heater-treater accepts a crude liquid hydrocarbon input stream from a two-phase separator. The two-phase separator includes a crude hydrocarbon input stream and includes an output stream including the crude liquid hydrocarbon stream that is inputted to the heater-treater. The method includes flowing the compressed mixture into a cooling unit to cool the compressed mixture, to form a cooled composition including liquid hydrocarbons. The method includes recovering the liquid hydrocarbons as a recovered liquid hydrocarbon stream. The method includes flowing the recovered liquid hydrocarbon stream into the two-phase separator.

Various aspects of the present invention provide an apparatus for recovering gaseous hydrocarbons from tank headspace as fuel on-site. The apparatus includes a compressor that accepts a hydrocarbon gas composition from headspace of a tank fed by a secondary separator. The secondary separator accepts a crude liquid hydrocarbon input stream from a primary separator. The primary separator includes a crude hydrocarbon input stream and includes an output stream that includes the crude liquid hydrocarbon stream that is inputted to the secondary separator. The apparatus includes a cooling unit that accepts the compressed mixture from the compressor and that forms a cooled composition including liquid hydrocarbons. The apparatus includes a flowline from the cooling unit for flowing the cooled composition to a buffer tank to form a buffered fuel composition. The apparatus also includes an outlet from headspace of the buffer tank that outputs a fuel gas composition for use as an on-site fuel.

Various aspects of the presently claimed invention provide advantages over other methods and apparatuses for petroleum processing or recovery. For example, various aspects of the present invention allow efficient and cost-effective recovery of gaseous hydrocarbons from tank headspace (e.g., rich gas) that are normally vented or flared, or that conventionally cannot be recovered with such high efficiency, for use as an on-site fuel. For example, compressors normally require regular oil changes for maintenance, resulting in downtime and increased cost. However, in various aspects of the present invention, by using an oilless compressor that is free of oil that contacts material being compressed and is free of oil lubrication that requires regular changings, the need for oil changes is eliminated, dramatically reducing the cost of hydrocarbon recovery.

In various aspects, the cooling unit of the present invention efficiently cools both large and small volumes of gas. The cooling unit can efficiently operate on a small scale which has the benefit of enabling the method to be deployed at well pads and other places where the rich (flare) gas or mixture of rich (flare) and sales gases are generated in small volumes. The ability of the method and apparatus of the present invention to operate economically in connection with rich gas that is generated at small volume is advantageous. This is because although any one such location is likely to give rise to only a relatively small volume of gas, failure to recover that small volume of gas at a large number of such locations (for example, one or more oil fields which have a large number of well pads that each generate a small volume of flare gas) will lead to a large cumulative volume of non-recovered rich gas. That large volume would, if flared, represent a large contribution to the oil field or operator's carbon footprint and associated emissions. The method and apparatus of the present invention thus provides a method of reducing the volume of fared gas at locations of crude oil production and at oil producing facilities.

In various aspects, the method and apparatus of the present invention can at least partially remove oxygen and/or other contaminants (e.g., sulfur, oxygen, and/or water) from the gaseous hydrocarbons from the tank headspace. In various aspects, the method and apparatus of the present invention can remove such contaminants more effectively and/or at higher efficiency than other methods and apparatuses for recovery of rich gas. For example, one particular challenge in the recovery of tank headspace gas is the intake of air or breathing. Breathing within a tank headspace volume can be attributed to ambient temperature changes and/or liquid level changes within the fixed volume of the storage space, with air entering or gases exiting the tank to make up for the resulting pressure change. Normal breathing of storage tanks contaminates the hydrocarbon gas headspace with oxygen from ambient air. Pipeline transmission requirements typically allow for only very low concentrations of oxygen. A unique advantage of various aspects of the present method and apparatus is the separation and decrease/elimination of oxygen from the recovered hydrocarbons that are used as on-site fuel.

In various aspects, the method and apparatus of the present invention avoids introduction of oxygen into the facility that can occur with recycling of tank headspace vapors. By providing recycled tank vapors as a liquid to a buffer tank, the buffer tank moderates the irregular gas production emanating from the facility tank battery. Upstream oil and gas facilities typically flare all low pressure gas from tank batteries as a least-cost means to control tank vapor emissions. Recovery of tank vapors is especially challenging due to oxygen that is present in the gas as a result of "tank breathing" in which air infiltrates thief hatches into the tank headspace as the tank temperature and liquid levels change. Oxygen present in the gas can preclude recovery to a gas gathering pipeline; however, this gas can be used as fuel for "on-lease" purposes. Oil and gas production facilities normally use gas associated with oil production as fuel for flare pilots, gas assist, heater treater burners, and other on-lease uses. Although tank vapors are available for such use, the application has largely been ignored because of the irregular production of tank vapors and the cost to recover the gas. Various aspects of the method and apparatus of the present invention provide a means to buffer the irregular gas production which controllably provides the gas as fuel at low cost. Storage of the buffered fuel composition as a gas/liquid mixture in the buffer tank provides an advantage of efficient storage due to the higher density of the liquid.

BRIEF DESCRIPTION OF THE FIGURES

The drawings illustrate generally, by way of example, but not by way of limitation, various aspects of the present invention.

DETAILED DESCRIPTION OF THE INVENTION

Figure 1:
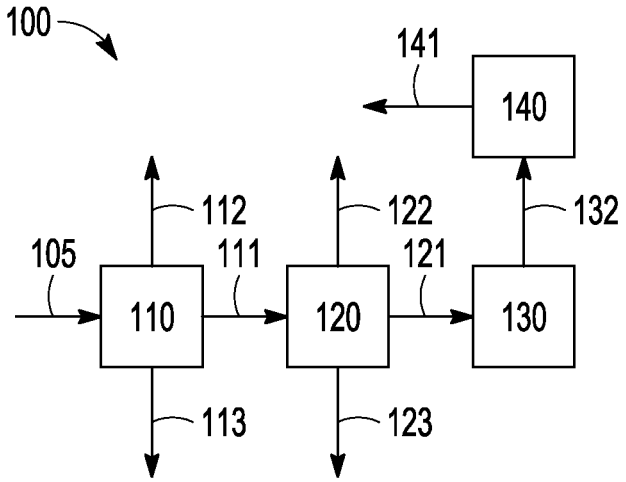
FIG. 1 illustrates a method and apparatus for recovering gaseous hydrocarbons from tank headspace as fuel on-site, in accordance with various aspects.

Reference will now be made in detail to certain aspects of the disclosed subject matter. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" or "at least one of A or B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the invention, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range. The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%. The term "substantially free of" as used herein can mean having none or having a trivial amount of, such that the amount of material present does not affect the material properties of the composition including the material, such that about 0 wt % to about 5 wt % of the composition is the material, or about 0 wt % to about 1 wt %, or about 5 wt % or less, or less than or equal to about 4.5 wt %, 4, 3.5, 3, 2.5, 2, 1.5, 1, 0.9, 0.8, 0.7, 0.6, 0.5, 0.4, 0.3, 0.2, 0.1, 0.01, or about 0.001 wt % or less, or about 0 wt %.

Method of Recovering Gaseous Hydrocarbons from Tank Headspace as Fuel On-Site.

Various aspects of the present invention provide a method of recovering gaseous hydrocarbons from tank headspace as an on-site fuel. The method can include flowing a hydrocarbon gas composition from headspace of a tank into a compressor to form a compressed mixture. The tank can be fed by a secondary separator. The secondary separator can accept a crude liquid hydrocarbon input stream from a primary separator. The primary separator can include a crude hydrocarbon input stream and can include an output stream including the crude liquid hydrocarbon stream that is inputted to the secondary separator. The method can include flowing the compressed mixture into a cooling unit to cool the compressed mixture, to form a cooled composition including liquid hydrocarbons. The method can include flowing the cooled composition to a buffer tank to form a buffered fuel composition. The method can include removing a fuel gas composition from headspace of the buffer tank. The method can also include combusting the fuel gas composition as an on-site fuel.

The crude hydrocarbon input stream can be any suitable hydrocarbon input stream. For example, the crude hydrocarbon input stream can be from an oil well. The oil well can be at an on-shore oil recovery or production facility or an off-shore oil recovery or production facility. The crude hydrocarbon input stream can have any suitable pressure, such as a pressure of 10 psi (70 kPa) to 500 psi (3447 kPa), or 50 psi (345 kPa) to 100 psi (689 kPa).

The primary separator can be any suitable separator that performs separation on the crude hydrocarbon input stream. The primary separator accepts the crude hydrocarbon input stream and outputs a crude hydrocarbon liquid stream and a crude hydrocarbon gaseous stream (e.g., sales and/or flare gas). The primary separator can also optionally output a water stream. The primary separator can include a two-phase separator (e.g., having liquid and gaseous outputs) or a three-phase separator (e.g., having a water output, a liquid hydrocarbon output, and a gaseous output). The primary separator can be heated (e.g., a heater-treater). The primary separator can be unheated (e.g., free-water-knockout (FWKO)). The primary separator can include a separator column. The primary separator can include a level sensor (e.g., a float-style level detector) to detect a height of liquid such as water and/or hydrocarbons. The primary separator can be operated at a pressure greater than 50 psi, such as 50-500 psi.

The hydrocarbon gas composition from the headspace of the tank is rich gas that is rich in ethane, propane, and butane, and has less than 50 mole % methane (e.g., 1 to <50 mole % methane). The hydrocarbon gas composition can have any suitable oxygen concentration, such as an oxygen concentration of 0 mole % to 20 mole % oxygen, or 1 mole % to 15 mole %, or 3 mole % to 6 mole %, or less than or equal to 20 mole % and greater than or equal to 0 mole %, 1, 2, 3, 4, 5, 6, 7, 8, 9, 10, 11, 12, 13, 14, 15, 16, 17, 18, or 19 mole % oxygen. In various aspects, the hydrocarbon gas composition is less than 10 mole % methane, up to 90 mole % ethane, propane, butane, and pentane, and up to 10 mole % of hydrocarbons heavier than pentane. The hydrocarbon gas composition from the headspace of the tank can have any suitable pressure, such as 0.01 psi (0.1 kPa) to 2 psi (14 kPa), or 0.1 psi (1 kPa) to 2 psi (14 kPa).

The method can optionally include flowing the hydrocarbon gas composition from the headspace of the tank to a primary recovery separator. The method can include flowing the hydrocarbon gas from the primary recovery separator to the compressor. The primary recovery separator can include a two-phase separator or a three-phase separator. The primary recovery separator can include a heated separator or an unheated separator. The primary recovery separator can include a scrubber. The primary recovery separator can condense liquids from the hydrocarbon gas composition, can remove water from the hydrocarbon gas composition, or a combination thereof. The primary recovery separator can provide a low point to knock-out moisture and other condensate prior to compression. Liquids (e.g., hydrocarbons and water) can drain from the bottom of the primary recovery separator. The primary recovery separator can include a level sensor to detect a height of liquid such as water and/or hydrocarbons. The method can include flowing a gaseous hydrocarbon stream from the primary recovery separator (e.g., sales and/or flare gas). The primary recovery separator can optionally include a hydrocarbon gas output that can include oxygen that is removed from the tank vapors.

The compressor can include any suitable type of compressor. The compressor can include a piston compressor, a scroll compressor, or a combination thereof. The compressor can include an oilless compressor. The oilless compressor can include a crankcase that is free of oil that contacts material being compressed and is free of oil lubrication that requires regular changings. The method can be free of compression via a compressor that includes oil that contacts material being compressed and/or that includes oil lubrication that requires regular changings. The compressed mixture formed by the compressor can have any suitable pressure, such as a pressure of 100 psi (689 kPa) to 500 psi (3447 kPa), or 200 psi (1379 kPa) to 300 psi (2068 kPa). The compressed mixture formed by the compressor can have any suitable temperature, such as a temperature of 100° C. to 300° C., or 125° C. to 175° C.

The cooling unit can be any suitable cooling unit that cools the compressed mixture. The cooling unit can include a heat exchanger, a refrigeration unit, an aftercooler, or a combination thereof. The cooling unit can include an air-cooled heat exchanger, a water-cooled heat exchanger, or a combination thereof. The cooling unit can include an air-cooled heat exchanger. The cooled composition can have any suitable pressure, such as a pressure of 100 psi (689 kPa) to 500 psi (3447 kPa), or 200 psi (1379 kPa) to 300 psi (2068 kPa). The cooled composition can have any suitable temperature that is less than the temperature of the compressed mixture formed by the compressor, such as a temperature of 0° C. to 80° C., or 10° C. to 40° C., or within 10° C. of ambient temperature.

The recovering of the liquid hydrocarbons from the cooling unit for use as fuel-on site can optionally include separating the liquid hydrocarbons from any gaseous hydrocarbons and/or water in the cooled composition. The method can include flowing the cooled composition including liquid hydrocarbons to a secondary recovery separator, and flowing the cooled composition to the buffer tank can include flowing a liquid hydrocarbon stream from the secondary recovery separator to the buffer tank. The secondary recovery separator can be any suitable separator. The secondary recovery separator can include a two-phase separator or a three-phase separator. The secondary recovery separator can include a heated separator or an unheated separator. The secondary recovery separator can include a separator column. The secondary recovery separator can include a level sensor to detect a height of liquid such as water and/or hydrocarbons. The method can include flowing a water stream from the secondary recovery separator. The method can include flowing a gaseous hydrocarbon stream from the secondary recovery separator (e.g., sales or flare gas).

Various aspects include a primary recovery separator with no secondary recovery separator. Various aspects include a secondary recovery separator with no primary recovery separator. Various aspects include both a primary recovery separator and a secondary recovery separator.

The secondary separator accepts the crude liquid hydrocarbon stream from the primary separator, and outputs a liquid hydrocarbon stream and a gaseous hydrocarbon stream (e.g., rich gas). The liquid hydrocarbon stream is fed to the tank. The liquid hydrocarbon stream can be fed directly to the tank. The liquid hydrocarbon stream can be fed indirectly to the tank; for example, the liquid hydrocarbon stream can be fed to the primary separator which can perform separation operations on the liquid hydrocarbon stream before feeding it to the tank. The secondary separator can be any suitable separator. For example, the secondary separator can include a two-phase separator or a three-phase phase separator. The secondary separator can include a heated separator or an unheated separator. The secondary separator can include a heater-treater or a vapor recovery tower (VRT). The secondary separator can include a heater-treater. The secondary separator can operate at any suitable pressure, and can feed the tank at any suitable pressure, such as a pressure of 5 psi (34 kPa) to 80 psi (552 kPa), or 20 psi (138 kPa) to 50 psi (344 kPa).

The fuel gas composition can include natural gas. The fuel gas composition can include methane, ethane, propane, butane, pentane, hydrocarbons having 6 or more carbon atoms, or a combination thereof. The fuel gas composition can include <10% methane, up to 90% ethane, propane, butane, and pentane, and up to 10% hydrocarbons heavier than pentane. The fuel gas composition can have less than 10 ppm oxygen, such as greater than or equal to 0, 0.001, 0.01, or 0.1 ppm oxygen and less than or equal to 10 ppm, 9, 8, 7, 6, 5, 4, 3, 2, 1, or 0.5 ppm oxygen. The fuel gas composition can have an oxygen concentration of 0 mole % to 20 mole % oxygen, or 0 mol % to 17 mole %, or 1 mole % to 15 mole %, or 3 mole % to 12 mole %, or less than or equal to 20 mole % and greater than or equal to 0 mole %, 1, 2, 3, 4, 5, 6, 7, 8, 9, 10, 11, 12, 13, 14, 15, 16, 17, 18, or 19 mole % oxygen.

The method includes combusting the fuel gas composition as an on-site fuel. Herein, the fuel gas composition can be referred as recovered by virtue of its combustion as fuel on-site. As used herein, "on-site" means at the same oil well, production facility, or recovery facility as the primary separator is located. Combusting the fuel gas composition as an on-site fuel can include flowing the fuel gas composition to an on-site fuel system. Combusting the fuel gas composition as an on-site fuel can include using the fuel gas composition to heat the primary separator, to heat the secondary separator, as a flare pilot, as gas assist (e.g., introduction of extra gas near flare tip, such as to eliminate smoke from a low-flow lazy flame at the flare), in an auxiliary internal combustion device for heat or power, or a combination thereof. Combusting the fuel gas composition as an on-site fuel includes using the fuel gas composition to heat the primary separator and/or the secondary separator.

Flowing the hydrocarbon gas composition from the headspace of the tank fed by the secondary separator into the compressor can include flowing the hydrocarbon gas composition from the headspace of the tank fed by the secondary separator to a flame arrestor and flowing the hydrocarbon gas composition from the flame arrestor into the compressor. The flame arrester can prevent a fire in the flowline from crossing into the tank (i.e., flashback to the tank). While tank vapors contain air/oxygen and are normally outside of explosive limits, unforeseen circumstances could result in a gas/air mixture that is within the range in which vapors could ignite; the flame arrestor prevents ignition from reaching the tank. The method can include monitoring a temperature of the compressed mixture, and shutting down the compressor if the temperature of the compressed mixture rises above a compressed mixture temperature setpoint; such a protocol can, for example, be used to prevent ignition of the composition in the compressor. The temperature setpoint can be any suitable temperature, such as 300-400° F. (149-204° C.), or 350° F. (177° C.), or less than 400° F. and greater than or equal to 300° F., 305, 310, 315, 320, 325, 330, 335, 340, 345, 350, 355, 360, 365, 370, 375, 380, 385, 390, or 395° F.

Flowing the hydrocarbon gas composition from the headspace of the tank fed by the secondary separator into the compressor can include flowing the hydrocarbon gas composition from the headspace of the tank fed by the secondary separator into (i.e., through) a filter and flowing the hydrocarbon from the filter into the compressor. The filter can eliminate or reduce fine particles from entering the compressor, which can cause premature wear of the compressor, such as wear of piston/cylinder surfaces or valve seals.

Any suitable proportion of on-site fuel needs can be satisfied by the combusting of the fuel gas composition. For example, 100% of on-site fuel needs can be satisfied by the combusting of the fuel gas composition, or 10-90%, or 50-90%, or less than or equal to 100% and greater than or equal to 1%, 2, 3, 4, 5, 10, 15, 20, 25, 30, 35, 40, 45, 50, 55, 60, 65, 70, 75, 80, 85, 90, or 95%. For example, 100% of fuel needs of the primary separator and/or the secondary separator can be satisfied by the combusting of the fuel gas composition as an on-site fuel, or 10-90%. In some embodiments, a portion of the on-site fuel needs, or a portion of the fuel needs of the primary separator and/or the secondary separator, can be satisfied by the combustion of fuels other than the fuel gas composition as on-site fuels.

The buffered fuel composition in the buffer tank can include the fuel gas composition and a fuel liquid composition. The fuel gas composition can be located within an upper portion of the buffer tank, and the fuel liquid composition can be located in a lower portion of the buffer tank. As fuel gas composition is removed from the buffer tank, the resulting reduction of pressure can cause a portion of the fuel liquid composition to volatilize, restoring the removed fuel gas composition and restoring the pressure of the buffer tank. Removing the fuel gas composition from the headspace of the buffer tank can include allowing the fuel gas composition to flow from the headspace of the buffer tank under pressure provided by the buffer tank, such as without assistance from a pump or compressor. The buffer tank can be operated (e.g., maintained during use) at any suitable pressure, such as a 25 psi to 300 psi (172-2068 kPa), 25 psi to 150 psi (172-1034 kPa), or less than or equal to 220 psi and greater than or equal to 25 psi, 30, 40, 50, 60, 70, 80, 90, 100, 110, 120, 130, 140, 150, 160, 170, 180, 190, 200, 210, 220, 230, 240, 250, 260, 270, 280, or 290 psi. The buffer tank can be operated (e.g., maintained during use) at any suitable temperature, such as a temperature of equal to or less than 20° C. above ambient temperature, equal to or less than 15° C. above ambient temperature, or equal to or less than 10° C. above ambient temperature, or equal or less than 5° C. above ambient temperature, wherein ambient temperature can be −40° C. to 38° C., or less than or equal to 38° C. and greater than or equal to −40° C., −35, −30, −25, −20, −15, −10, −5, 0, 5, 10, 15, 20, 25, 30, or 35° C. The buffer tank can have any suitable capacity, such as a capacity of 250 gallons to 10,000 gallons (~1,000 L to ~40,000 L), or 500 gallons to 1,000 gallons (~1,500 L to ~4,000 L). The method can include monitoring a liquid level in the buffer tank, a temperature in the buffer tank, a pressure in the buffer tank, a pressure in the tank fed by the secondary separator, a temperature of the cooled composition exiting the compressor, or a combination thereof.

The buffer tank can include an outlet in an upper portion thereof that is fluidly connected to an emergency pressure release valve. The buffer tank can include an outlet in an upper portion thereof feeding to a back pressure regulator value that is fluidly connected to a flare. The buffer tank can include a fuel gas outlet in an upper portion thereof through which the fuel gas composition is flowed. The fuel gas outlet can flow to a regulator valve that controllably flows the fuel gas composition to one or more combustors in which the combusting of the fuel gas composition as an on-site fuel is performed. The regulator valve can regulate the flow of the fuel gas composition to the one or more combustors at any suitable pressure, such as 5 psi to 20 psi (34-138 kPa), or 10 psi to 15 psi (69-103 kPa), or equal to or less than 20 psi and greater than or equal to 5, 6, 7, 8, 9, 10, 11, 12, 13, 14, 15, 16, 17, 18, or 19 psi. The fuel gas outlet can flow to a solenoid valve that controllably flows the fuel gas composition to one or more combustors in which the combusting of the fuel gas composition as an on on-site fuel is performed. The fuel gas outlet can flow to a solenoid valve and a regulator valve in series that controllably flow the fuel gas composition to one or more combustors in which the combusting of the fuel gas composition as an on-site fuel is performed. In various embodiments, the fuel gas outlet can be fluidly connected to the solenoid valve and regulator valve in series to controllably flow the fuel gas composition to one or more combustors, and also fluidly connected to the back pressure regulator value that is fluidly connected to the flare. The tank can include a drain in a lower portion thereof, wherein the drain includes a drain valve that is fluidly connected to a produced water tank.

The method can include using a processor configured to monitor a liquid level in the buffer tank, a temperature in the buffer tank, a pressure in the buffer tank, a pressure in the tank fed by the secondary separator, a temperature of the cooled composition exiting the compressor, or a combination thereof. The processor can be a component of a programmable logic controller. Monitoring the liquid level in the buffer tank can include monitoring a level transmitter in a lower portion of the buffer tank and monitoring a level transmitter in an upper portion of the buffer tank. The level transmitter in the lower portion of the buffer tank can monitor a level of water in the tank, and the level transmitter in the upper portion of the buffer tank can monitor a level of water or hydrocarbon liquids in the buffer tank. Monitoring the pressure in the buffer tank can include monitoring a pressure transducer or pressure transmitter in an upper portion of the buffer tank (e.g., in the headspace of the buffer tank). Monitoring the pressure in the tank fed by the secondary separator can include monitoring a pressure transducer or pressure transmitter in an upper portion of the tank fed by the secondary separator. The processor can be configured to: responsive to determining a level transmitter in a lower portion of the buffer tank is immersed, indicating that water is at or above the level transmitter in the lower portion of the buffer tank, cause water to be drained from the buffer tank or signal an operator to perform draining of water from the buffer tank; responsive to determining a level transmitter in an upper portion of the buffer tank is immersed, cause a variable frequency drive on the compressor to run at a lower speed or to shut off, responsive to determining that a pressure transducer or pressure transmitter in an upper portion of the tank fed by the secondary separator is detecting a pressure above a predetermined pressure threshold, cause the variable frequency drive on the compressor to run at a lower speed or to shut off, responsive to determining that the pressure transducer or pressure transmitter in the upper portion of the tank fed by the secondary separator is detecting a pressure below a predetermined pressure threshold, cause the variable frequency drive on the compressor to maintain speed or to run at a higher speed; responsive to determining that a temperature transducer or temperature transmitter measuring temperature of the compressed mixture exiting the compressor is detecting a temperature above a compressed mixture temperature setpoint, cause a variable frequency drive on the compressor to slow or stop; or a combination thereof.

In various aspects of the method or apparatus of the present invention, the speed of the compressor can be automatically controlled to maintain a setpoint pressure at the pressure transducer or pressure transmitter in the upper portion of the tank fed by the secondary separator. If flow from the tank fed by the secondary separator overwhelms the capacity of the compressor, gas can be flared through tank mechanical controls and the compressor can be allowed to run at maximum speed. If the pressure detected in the tank fed by the secondary separator drops below the setpoint pressure, the compressor is caused to slow or shut off until the detected pressure returns to the setpoint pressure. The emergency pressure relief valve can be used to prevent over-pressurizing of the buffer tank (e.g., 80% of maximum pressure rating of buffer tank, such as 80% of 250 psi). The back pressure regulator can be redundant relative to the emergency pressure relief valve and can be set to a lower pressure than the emergency pressure relief valve (e.g., 75% or less of maximum pressure rating of buffer tank, such as 75% of 250 psi). In the event of fuel gas demand being less than the fuel supply from the compressor, the pressure can increase in the buffer tank until the back pressure valve opens. While pressure is maintained by the back pressure value, the tank can fill with liquid until the level transmitter in an upper portion of the buffer tank (e.g., which can float in water and liquids lighter than water) is immersed, and then the compressor can be caused to run at a lower speed or to shut off. In the event of fuel gas demand being greater than the fuel supply from the compressor, the pressure can decrease in the buffer tank, and the liquid level can decrease in the buffer tank. When a low pressure setpoint is detected by a pressure transducer or pressure transmitter in an upper portion of the buffer tank (e.g., in the headspace of the buffer tank), the solenoid valve can be caused to close until pressure in the buffer tank rises above the low pressure setpoint. In the event the buffer tank has sufficient water that the water rises to the level transmitter in the lower portion of the buffer tank, the system can automatically open a valve on the drain of the buffer tank, or an operator can open the valve, to lower the lever of water in the buffer tank until it is below the height of the level transmitter in the lower portion of the buffer tank. If water is detected by the level transmitter in the upper portion of the buffer tank, the compressor can be caused to shut down.

Apparatus for Recovering Gaseous Hydrocarbons from Tank Headspace as Fuel On-Site.

Various aspects of the present invention provide an apparatus for performing aspects of the method of the present invention for recovering gaseous hydrocarbons from tank headspace as fuel on-site. The apparatus can be any suitable apparatus that can perform the method described herein. For example, the apparatus can include a compressor that accepts a hydrocarbon gas composition from headspace of a tank fed by a secondary separator. The secondary separator can accept a crude liquid hydrocarbon input stream from a primary separator. The primary separator can include a crude hydrocarbon input stream and include an output stream that includes the crude liquid hydrocarbon stream that is inputted to the secondary separator. The apparatus can include a cooling unit that accepts the compressed mixture from the compressor and that forms a cooled composition including liquid hydrocarbons. The apparatus can include a flowline from the cooling unit for flowing the cooled composition to a buffer tank to form a buffered fuel composition. The apparatus can also include an outlet from headspace of the buffer tank that outputs a fuel gas composition for use as an on-site fuel. The apparatus, including the primary separator, secondary separator, compressor, cooler, optional primary recovery separator, optionally secondary recovery separator, buffer tank, or a combination thereof, can include can one or more suitable features as disclosed herein with respect to the method of the present invention for recovering gaseous hydrocarbons from tank headspace.

The apparatus can optionally further include a primary recovery separator that accepts the hydrocarbon gas composition from headspace of the tank fed by the secondary separator and that flows the hydrocarbon gas composition from the primary recovery separator to the compressor.

The apparatus can optionally further include a secondary recovery separator that accepts the cooled composition including the liquid hydrocarbons and the outputs the recovered liquid hydrocarbon stream to the buffer tank.

FIG. 1 illustrates a method and apparatus for recovering gaseous hydrocarbons from tank headspace as fuel on-site, in accordance with various aspects. Apparatus 100 includes crude hydrocarbon input stream 105 which is fed to primary separator 110. The primary separator 110 outputs crude liquid hydrocarbon stream 111. The primary separator 110 optionally outputs hydrocarbon gas stream 112 (first stage gas). The primary separator 110 optionally outputs water stream 113. The crude liquid hydrocarbon stream 111 is fed to secondary separator 120. The secondary separator 120 outputs liquid hydrocarbon stream 121. The secondary separator 120 optionally outputs hydrocarbon gas stream 122 (second stage gas). The secondary separator 120 optionally outputs water stream 123. Water streams 113 and 123 can be combined and sent to a tank for storage and or treatment. Liquid hydrocarbon stream 121 is fed to tank 130. A hydrocarbon gas composition (headspace gas) 132 is flowed from the headspace of tank 130 into an apparatus 140 for recovering gaseous hydrocarbons from tank headspace according to the present invention. Apparatus 140 outputs recovered liquid hydrocarbon stream 141 to a buffer tank (not shown). Various aspects of apparatus 140 are illustrated in detail in FIGS. 3 and 4.

Figure 2A:
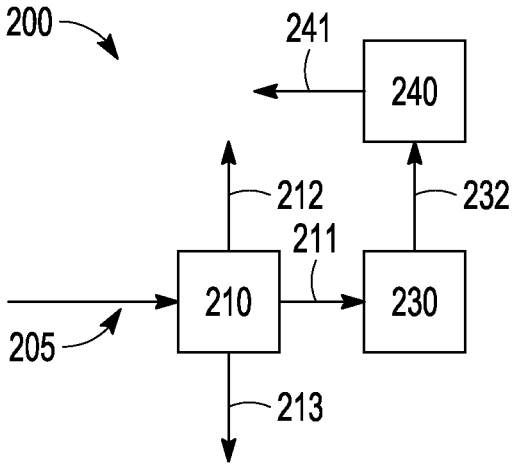
FIG. 2A illustrates a method and apparatus for recovering gaseous hydrocarbons from tank headspace as fuel on-site, in accordance with various aspects.

FIG. 2A illustrates a method and apparatus for recovering gaseous hydrocarbons from tank headspace as fuel on-site, in accordance with various aspects. Apparatus 200 includes crude hydrocarbon input stream 205 which is fed to primary separator 210. In other aspects, separator 210 can be a secondary separator. The primary separator 210 outputs crude liquid hydrocarbon stream 211. The primary separator 210 outputs hydrocarbon gas stream 212 (first stage gas). The primary separator 210 optionally outputs water stream 213. Crude liquid hydrocarbon stream 211 is fed to tank 230. A hydrocarbon gas composition (headspace gas) 232 is flowed from the headspace of tank 230 into an apparatus 240 for recovering gaseous hydrocarbons from tank headspace according to the present invention. Apparatus 240 outputs recovered liquid hydrocarbon stream 241 to a buffer tank (not shown). Various aspects of apparatus 240 are illustrated in detail in FIGS. 3 and 4.

Figure 2B:
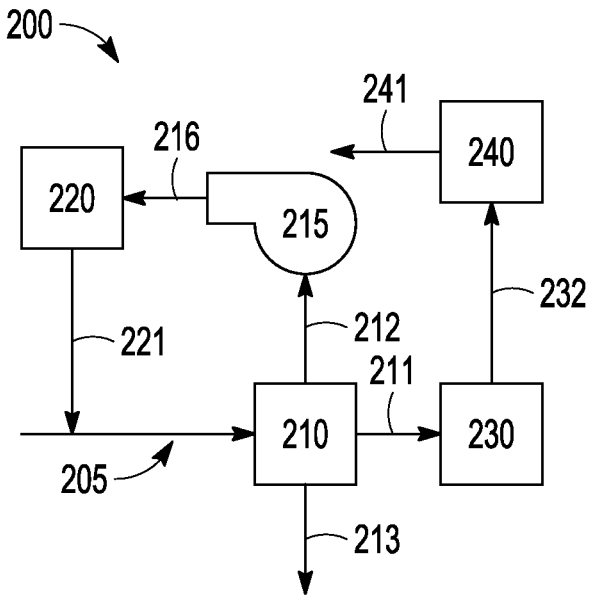
FIG. 2B illustrates a method and apparatus for recovering gaseous hydrocarbons from tank headspace as fuel on-site, in accordance with various aspects.

FIG. 2B illustrates an embodiment of the apparatus 200 shown in FIG. 2A including additional features. FIG. 2B illustrates a method and apparatus for recovering gaseous hydrocarbons from tank headspace as fuel on-site, in accordance with various aspects. Apparatus 200 includes crude hydrocarbon input stream 205 which is fed to primary separator 210. In other aspects, separator 210 can be a secondary separator. The primary separator 210 outputs crude liquid hydrocarbon stream 211. The primary separator 210 outputs hydrocarbon gas stream 212 (first stage gas). The primary separator 210 optionally outputs water stream 213. The primary separator outputs hydrocarbon gas stream 210. The hydrocarbon gas stream 212 is fed to compressor 215, which generates a compressed gas stream 216. Compressed gas stream 216 is fed to secondary separator 220 which outputs liquid hydrocarbon stream 221. Secondary separator 220 can also optionally output hydrocarbon gas and water streams (not shown). Liquid hydrocarbon stream 221 is combined with crude hydrocarbon input stream 205. The primary separator outputs liquid hydrocarbon stream 221 which is fed to tank 230. The liquid hydrocarbon stream 221 is thereby fed to the tank 230 by first passing through (and having separatory operations performed thereon in) primary separator 210. A hydrocarbon gas composition (headspace gas) 232 is flowed from the headspace of tank 230 into an apparatus 240 for recovering gaseous hydrocarbons from tank headspace according to the present invention. Apparatus 240 outputs recovered liquid hydrocarbon stream 241 to a buffer tank (not shown). Various aspects of apparatus 240 are illustrated in detail in FIGS. 3 and 4.

Figure 3:
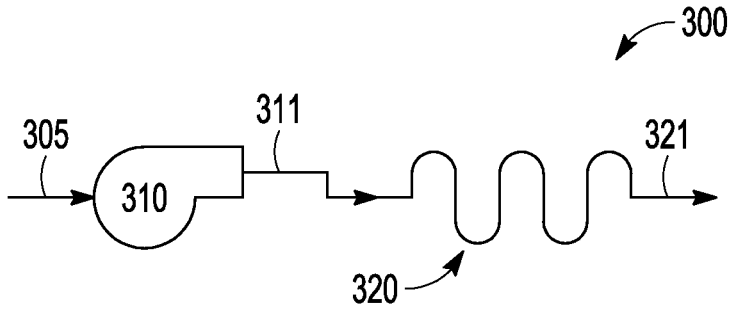
FIG. 3 illustrates a method and apparatus for recovering gaseous hydrocarbons as fuel on-site, in accordance with various aspects.

FIG. 3 illustrates a method and apparatus for recovering gaseous hydrocarbons as fuel on-site, in accordance with various aspects. Apparatus 300 includes compressor 310, which is fed by the hydrocarbon gas composition (headspace gas) 305. The compressor outputs compressed mixture 311, which is fed to cooling unit 320. Cooling unit 320 forms a cooled composition including liquid hydrocarbons 321.

Figure 4:
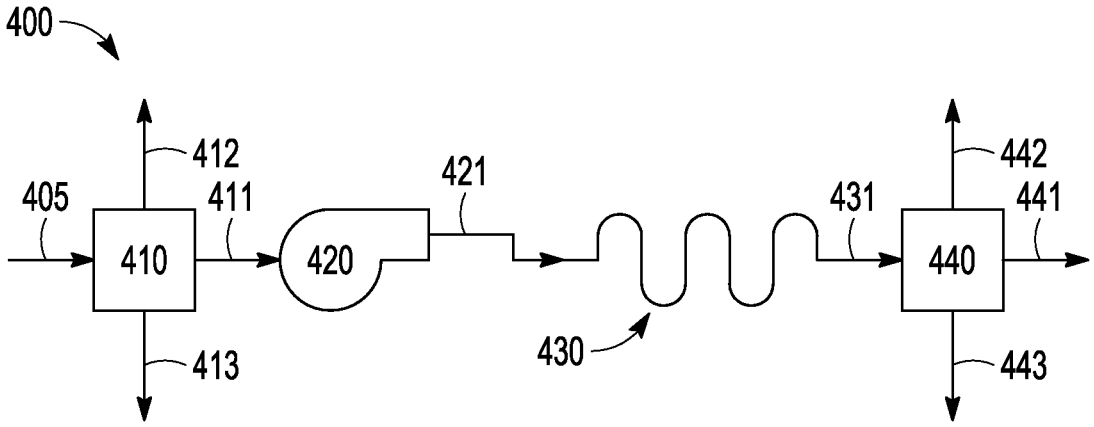
FIG. 4 illustrates a method and apparatus for recovering gaseous hydrocarbons as fuel on-site, in accordance with various aspects.

FIG. 4 illustrates a method and apparatus for recovering gaseous hydrocarbons as fuel on-site, in accordance with various aspects. Apparatus 400 includes a primary recovery separator 410, which is fed by the hydrocarbon gas composition (headspace gas) 405. Primary recovery separator outputs hydrocarbon gas composition 411. Primary recovery separator can optionally output water stream 413 and hydrocarbon gas stream 412. Hydrocarbon gas composition 411 is fed to compressor 420, which forms compressed mixture 421. The compressed mixture is fed to cooling unit 430, which forms cooled composition 431 including liquid hydrocarbons. The cooled composition including liquid hydrocarbons 431 is fed to secondary recovery separator 440. Secondary recovery separator 440 forms a liquid composition including the liquid hydrocarbons 441, which is fed to a buffer tank (not shown). Secondary recovery separator 440 optionally forms hydrocarbon gas stream 442 and water stream 443.

Figure 5:
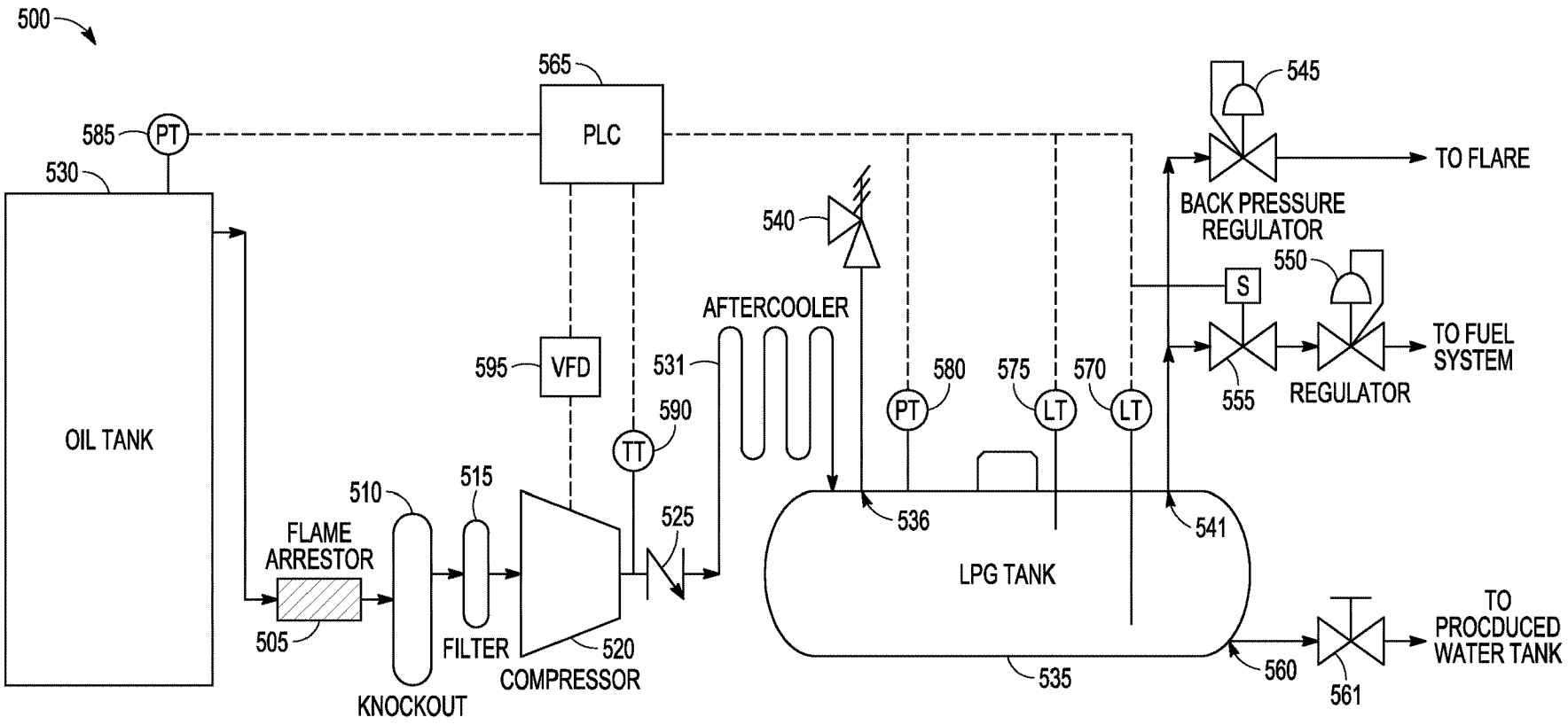
FIG. 5 illustrates a method and apparatus for recovering gaseous hydrocarbons as fuel on-site, in accordance with various aspects.

FIG. 5 illustrates a method and apparatus for recovering gaseous hydrocarbons as fuel on-site, in accordance with various aspects. In apparatus 500, a hydrocarbon gas composition (headspace gas) is flowed from the headspace of tank 530 (corresponding to tanks 140 and 240 in FIGS. 1, 2A, and 2B) into flame arrestor 505, and then into primary recovery separator 510. The primary recovery separator 510 outputs a hydrocarbon gas composition to filter 515 which outputs the filtered stream to compressor 520, which forms a compressed mixture. The compressed mixture is fed to check valve 525 (which can prevent reverse flow) and then to cooling unit 531, which forms a cooled composition including liquid hydrocarbons that is fed to buffer tank 535. The buffer tank 535 can include an outlet 536 in an upper portion thereof that is fluidly connected to an emergency pressure release valve 540. The buffer tank 535 can include a fuel gas outlet 541 in an upper portion thereof feeding to a back pressure regulator value 545 that is fluidly connected to a flare. The buffer tank can include a fuel gas outlet 541 in an upper portion thereof through which the fuel gas composition is flowed. The fuel gas outlet 541 can flow to a regulator valve 550 that controllably flows the fuel gas composition to one or more combustors in which the combusting of the fuel gas composition as an on-site fuel is performed. The regulator valve 550 can regulate the flow of the fuel gas composition to the one or more combustors at any suitable pressure, such as 5 psi to 20 psi (34-138 kPa), or 10 psi to 15 psi (69-103 kPa), or equal to or less than 20 psi and greater than or equal to 5, 6, 7, 8, 9, 10, 11, 12, 13, 14, 15, 16, 17, 18, or 19 psi. The fuel gas outlet can flow to a solenoid valve 555 that controllably flows the fuel gas composition to one or more combustors in which the combusting of the fuel gas composition as an on on-site fuel is performed. The fuel gas outlet can flow to a solenoid valve 555 and a regulator valve 550 in series that controllably flow the fuel gas composition to one or more combustors in which the combusting of the fuel gas composition as an on-site fuel is performed. The tank can include a drain 560 in a lower portion thereof, wherein the drain includes a drain valve 561 that is fluidly connected to a produced water tank.

The method can include using a processor 565 configured to monitor a liquid level in the buffer tank 535, a temperature in the buffer tank 535, a pressure in the buffer tank 535, a pressure in the tank 530 fed by the secondary separator, a temperature of the cooled composition exiting the compressor 520, or a combination thereof. The processor 565 can be a component of a programmable logic controller. Monitoring the liquid level in the buffer tank 535 can include monitoring a level transmitter 570 in a lower portion of the buffer tank and monitoring a level transmitter 575 in an upper portion of the buffer tank (e.g., in the headspace of the buffer tank). Monitoring the pressure in the buffer tank can include monitoring a pressure transducer or pressure transmitter 580 in an upper portion of the buffer tank. Monitoring the pressure in the tank 530 fed by the secondary separator can include monitoring a pressure transducer or pressure transmitter 585 in an upper portion of the buffer tank.

The processor 565 can be configured to: responsive to determining a level transmitter 575 in an upper portion of the buffer tank is immersed (e.g., with hydrocarbon liquid or water), to cause the variable frequency drive 595 on the compressor 520 to slow or stop the compressor, and to optionally provide an operator alert; responsive to determining a level transmitter 570 in a lower portion of the buffer tank is immersed with water, to provide an operator alert and/or to automatically open valve 561; responsive to determining a pressure transducer or pressure transmitter 585 in upper portion of the tank fed by the secondary separator (e.g., in the headspace of the tank) is above a pressure setpoint, to cause a variable frequency drive 595 on the compressor 520 to start or speed up the compressor; responsive to determining that a pressure transducer or pressure transmitter 585 in an upper portion of the tank fed by the secondary separator (e.g., in the headspace of the tank) is below a pressure setpoint, to cause a variable frequency drive 595 on the compressor 520 to slow down or stop the compressor; responsive to determining that a pressure transducer or pressure transmitter 580 in an upper portion of the buffer tank 535 is detecting a pressure above a predetermined pressure threshold, cause the solenoid valve 555 to at least partially open to start or increase a flow the fuel gas composition to the one or more combustors that perform the combustion of the fuel gas composition as an on-site fuel; responsive to determining that the pressure transducer or pressure transmitter 580 in the upper portion of the buffer tank 535 is detecting a pressure below a predetermined pressure threshold, cause the solenoid valve 555 to at least partially close to stop or decrease a flow of the fuel gas composition to the one or more combustors that perform the combustion of the fuel gas composition as an on-site fuel; responsive to determining that a temperature transducer or temperature transmitter 590 measuring temperature of the compressed mixture exiting the compressor 520 is detecting a temperature above a compressed mixture temperature setpoint, cause a variable frequency drive 595 on the compressor 520 to slow or stop the compressor; or a combination thereof.

The terms and expressions that have been employed are used as terms of description and not of limitation, and there is no intention in the use of such terms and expressions of excluding any equivalents of the features shown and described or portions thereof, but it is recognized that various modifications are possible within the scope of the aspects of the present invention. Thus, it should be understood that although the present invention has been specifically disclosed by specific aspects and optional features, modification and variation of the concepts herein disclosed may be resorted to by those of ordinary skill in the art, and that such modifications and variations are considered to be within the scope of aspects of the present invention.

EXEMPLARY ASPECTS

The following exemplary aspects are provided, the numbering of which is not to be construed as designating levels of importance:

Aspect 1 provides a method of recovering gaseous hydrocarbons from tank headspace as fuel on-site, the method comprising:

flowing a hydrocarbon gas composition from headspace of a tank fed by a secondary separator into a compressor to form a compressed mixture, wherein the secondary separator accepts a crude liquid hydrocarbon input stream from a primary separator, wherein the primary separator comprises a crude hydrocarbon input stream and comprises an output stream comprising the crude liquid hydrocarbon stream that is inputted to the secondary separator;

flowing the compressed mixture into a cooling unit to cool the compressed mixture, to form a cooled composition comprising liquid hydrocarbons;

flowing the cooled composition to a buffer tank to form a buffered fuel composition;

removing a fuel gas composition from headspace of the buffer tank; and combusting the fuel gas composition as an on-site fuel.

Aspect 2 provides the method of Aspect 1, wherein combusting the fuel gas composition as an on-site fuel comprises flowing the fuel gas composition to an on-site fuel system.

Aspect 3 provides the method of any one of Aspects 1-2, wherein combusting the fuel gas composition as an on-site fuel comprises using the fuel gas composition to heat the primary separator, to heat the secondary separator, as a flare pilot, as gas assist, in an auxiliary internal combustion device for heat or power, or a combination thereof.

Aspect 4 provides the method of any one of Aspects 1-3, wherein combusting the fuel gas composition as an on-site fuel comprises using the fuel gas composition to heat the primary separator and/or the secondary separator.

Aspect 5 provides the method of any one of Aspects 1-4, wherein flowing the hydrocarbon gas composition from the headspace of the tank fed by the secondary separator into the compressor comprises flowing the hydrocarbon gas composition from the headspace of the tank fed by the secondary separator to a flame arrestor and flowing the hydrocarbon gas composition from the flame arrestor into the compressor.

Aspect 6 provides the method of Aspect 5, further comprising monitoring a temperature of the compressed mixture, and shutting down the compressor if the temperature of the compressed mixture rises above a compressed mixture temperature setpoint.

Aspect 7 provides the method of Aspect 6, wherein the temperature setpoint is 300-400° F. (149-204° C.).

Aspect 8 provides the method of Aspect 6, wherein the temperature setpoint is 350° F. (177° C.).

Aspect 9 provides the method of any one of Aspects 1-8, wherein flowing the hydrocarbon gas composition from the headspace of the tank fed by the secondary separator into the compressor comprises flowing the hydrocarbon gas composition from the headspace of the tank fed by the secondary separator into a filter and flowing the hydrocarbon from the filter into the compressor.

Aspect 10 provides the method of any one of Aspects 1-9, wherein 100% of on-site fuel needs are satisfied by the combusting of the fuel gas composition as an on-site fuel.

Aspect 11 provides the method of any one of Aspects 1-10, wherein on-site fuel needs are satisfied by a combination of the combusting of the fuel gas composition as an on-site fuel and combustion of other fuels as an on-site fuel.

Aspect 12 provides the method of any one of Aspects 1-11, wherein 100% of fuel needs of the primary separator and/or the secondary separator are satisfied by the combusting of the fuel gas composition as an on-site fuel.

Aspect 13 provides the method of any one of Aspects 1-12, wherein on-site fuel needs of the primary separator and/or the secondary separator are satisfied by a combination of the combusting of the fuel gas composition as an on-site fuel and combustion of other fuels as an on-site fuel.

Aspect 14 provides the method of any one of Aspects 1-13, wherein the buffered fuel composition in the buffer tank comprises the fuel gas composition and a fuel liquid composition.

Aspect 15 provides the method of any one of Aspects 1-14, comprising operating the buffer tank at a pressure of 25 psi to 300 psi (172-2068 kPa).

Aspect 16 provides the method of any one of Aspects 1-15, comprising operating the buffer tank at a pressure of 25 psi to 150 psi (172-1034 kPa).

Aspect 17 provides the method of any one of Aspects 1-16, comprising operating the buffer tank at a temperature of equal to or less than 20° C. above ambient temperature.

Aspect 18 provides the method of any one of Aspects 1-17, comprising operating the buffer tank at a temperature of equal to or less than 10° C. above ambient temperature.

Aspect 19 provides the method of any one of Aspects 1-18, wherein the buffer tank has a capacity of 1,000 L to 40,000 L.

Aspect 20 provides the method of any one of Aspects 1-19, wherein the buffer tank has a capacity of 1,500 L to 4,000 L.

Aspect 21 provides the method of any one of Aspects 1-20, further comprising monitoring a liquid level in the buffer tank, a temperature in the buffer tank, a pressure in the buffer tank, a pressure in the tank fed by the secondary separator, a temperature of the cooled composition exiting the compressor, or a combination thereof.

Aspect 22 provides the method of any one of Aspects 1-21, wherein the tank comprises an outlet in an upper portion thereof that is fluidly connected to an emergency pressure release valve.

Aspect 23 provides the method of any one of Aspects 1-22, wherein the tank comprises an outlet in an upper portion thereof feeding to a back pressure regulator value that is fluidly connected to a flare.

Aspect 24 provides the method of any one of Aspects 1-23, wherein the tank comprises a fuel gas outlet in an upper portion thereof through which the fuel gas composition is flowed.

Aspect 25 provides the method of Aspect 24, wherein the fuel gas outlet flows to a regulator valve that controllably flows the fuel gas composition to one or more combustors in which the combusting of the fuel gas composition as an on-site fuel is performed.

Aspect 26 provides the method of Aspect 25, wherein the regulator regulates the flow of the fuel gas composition to the one or more combustors at 5 psi to 20 psi (34-138 kPa).

Aspect 27 provides the method of Aspect 25, wherein the regulator regulates the flow of the fuel gas composition to the one or more combustors at 10 psi to 15 psi (69-103 kPa).

Aspect 28 provides the method of any one of Aspects 24-27, wherein the fuel gas outlet flows to a solenoid valve that controllably flows the fuel gas composition to one or more combustors in which the combusting of the fuel gas composition as an on on-site fuel is performed.

Aspect 29 provides the method of any one of Aspects 24-28, wherein the fuel gas outlet flows to a solenoid valve and a regulator valve in series that controllably flow the fuel gas composition to one or more combustors in which the combusting of the fuel gas composition as an on-site fuel is performed.

Aspect 30 provides the method of any one of Aspects 1-29, wherein removing the fuel gas composition from the headspace of the buffer tank comprises allowing the fuel gas composition to flow from the headspace of the buffer tank under pressure provided by the buffer tank.

Aspect 31 provides the method of any one of Aspects 1-30, wherein the tank comprises a drain in a lower portion thereof, wherein the drain comprises a drain valve that is fluidly connected to a produced water tank.

Aspect 32 provides the method of any one of Aspects 1-31, further comprising using a processor configured to monitor a liquid level in the buffer tank, a temperature in the buffer tank, a pressure in the buffer tank, a pressure in the tank fed by the secondary separator, a temperature of the cooled composition exiting the compressor, or a combination thereof.

Aspect 33 provides the method of claim 32, wherein a programmable logic controller comprises the processor.

Aspect 34 provides the method of any one of Aspects 32-33, wherein monitoring the liquid level in the buffer tank comprises monitoring a level transmitter in a lower portion of the buffer tank and monitoring a level transmitter in an upper portion of the buffer tank.

Aspect 35 provides the method of any one of Aspects 32-34, wherein monitoring the pressure in the buffer tank comprises monitoring a pressure transducer or pressure transmitter in an upper portion of the buffer tank.

Aspect 36 provides the method of any one of Aspects 32-35, wherein monitoring the pressure in the tank fed by the secondary separator comprises monitoring a pressure transducer or pressure transmitter in an upper portion of tank fed by the secondary separator.

Aspect 37 provides the method of any one of Aspects 32-36, wherein the processor is configured to:

responsive to determining a level transmitter in a lower portion of the buffer tank is immersed in water, cause water to be at least partially drained from the buffer tank;

responsive to determining a level transmitter in an upper portion of the buffer tank is immersed, cause a variable frequency drive on the compressor to run at a lower speed or to shut off;

responsive to determining that a pressure transducer or pressure transmitter in an upper portion of the tank fed by the secondary separator is detecting a pressure above a predetermined pressure threshold, cause the variable frequency drive on the compressor to run at a lower speed or to shut off;

responsive to determining that the pressure transducer or pressure transmitter in the upper portion of the tank fed by the secondary separator is detecting a pressure below a predetermined pressure threshold, cause the variable frequency drive on the compressor to maintain speed or to run at a higher speed;

responsive to determining that a temperature transducer or temperature transmitter measuring temperature of the compressed mixture exiting the compressor is detecting a temperature above a compressed mixture temperature setpoint, cause the variable frequency drive on the compressor to slow or stop; or a combination thereof.

Aspect 38 provides the method of any one of Aspects 1-37, wherein the crude hydrocarbon input stream is from an oil well at an on-shore oil recovery or production facility.

Aspect 39 provides the method of any one of Aspects 1-37, wherein the crude hydrocarbon input stream is from an oil well at an off-shore oil recovery or production facility.

Aspect 40 provides the method of any one of Aspects 1-39, wherein the crude hydrocarbon input stream has a pressure of 10 psi (70 kPa) to 500 psi (3447 kPa).

Aspect 41 provides the method of any one of Aspects 1-40, wherein the crude hydrocarbon input stream has a pressure of 50 psi (345 kPa) to 100 psi (689 kPa).

Aspect 42 provides the method of any one of Aspects 1-41, wherein the primary separator comprises a two-phase separator or a three-phase separator.

Aspect 43 provides the method of any one of Aspects 1-42, wherein the primary separator comprises a heated separator.

Aspect 44 provides the method of any one of Aspects 1-42, wherein the primary separator comprises an unheated separator.

Aspect 45 provides the method of any one of Aspects 1-44, wherein the primary separator comprises a two-phase separator.

Aspect 46 provides the method of any one of Aspects 1-45, wherein the primary separator comprises the crude liquid hydrocarbon output stream and a crude hydrocarbon gaseous output stream.

Aspect 47 provides the method of any one of Aspects 1-46, wherein the hydrocarbon gas composition from the headspace of the tank comprises methane, ethane, propane, butane, hydrocarbons having 5 or more carbon atoms, or a combination thereof.

Aspect 48 provides the method of any one of Aspects 1-47, wherein the hydrocarbon gas composition from the headspace of the tank is less than 50 mole % methane and is predominantly ethane, propane, and butane.

Aspect 49 provides the method of any one of Aspects 1-48, wherein the hydrocarbon gas composition from the headspace of the tank has a pressure of 0.01 psi (0.1 kPa) to 2 psi (14 kPa).

Aspect 50 provides the method of any one of Aspects 1-49, wherein the hydrocarbon gas composition from the headspace of the tank has a pressure of 0.1 psi (1 kPa) to 2 psi (14 kPa).

Aspect 51 provides the method of any one of Aspects 1-50, further comprising flowing the hydrocarbon gas composition from the headspace of the tank to a primary recovery separator, and flowing the hydrocarbon gas composition from the primary recovery separator to the compressor.

Aspect 52 provides the method of Aspect 51, wherein the primary recovery separator comprises a two-phase separator or a three-phase separator.

Aspect 53 provides the method of any one of Aspects 51-52, wherein the primary recovery separator comprises a heated separator.

Aspect 54 provides the method of any one of Aspects 51-52, wherein the primary recovery separator comprises an unheated separator.

Aspect 55 provides the method of any one of Aspects 51-54, wherein the primary recovery separator comprises a scrubber.

Aspect 56 provides the method of any one of Aspects 51-55, wherein the primary recovery separator condenses liquids from the hydrocarbon gas composition, removes water from the hydrocarbon gas composition, or a combination thereof.

Aspect 57 provides the method of any one of Aspects 1-56, wherein the compressor comprises a piston compressor, a scroll compressor, or a combination thereof.

Aspect 58 provides the method of any one of Aspects 1-57, wherein the compressor comprises an oilless compressor, wherein the oilless compressor comprises a crankcase that is free of oil that contacts material being compressed and is free of oil lubrication that requires regular changings.

Aspect 59 provides the method of any one of Aspects 1-58, wherein the method is free of compression via a compressor that comprises oil that contacts material being compressed and/or that comprises oil lubrication that requires regular changings.

Aspect 60 provides the method of any one of Aspects 1-59, wherein the compressed mixture has a pressure of 100 psi (689 kPa) to 500 psi (3447 kPa).

Aspect 61 provides the method of any one of Aspects 1-60, wherein the compressed mixture has a pressure of 200 psi (1379 kPa) to 300 psi (2068 kPa).

Aspect 62 provides the method of any one of Aspects 1-61, wherein the compressed mixture has a temperature of 100° C. to 300° C.

Aspect 63 provides the method of any one of Aspects 1-62, wherein the compressed mixture has a temperature of 125° C. to 175° C.

Aspect 64 provides the method of any one of Aspects 1-63, wherein the cooling unit comprises a heat exchanger, a refrigeration unit, an aftercooler, or a combination thereof.

Aspect 65 provides the method of any one of Aspects 1-64, wherein the cooling unit comprises an air-cooled heat exchanger, a water-cooled heat exchanger, or a combination thereof.

Aspect 66 provides the method of any one of Aspects 1-65, wherein the cooling unit comprises an air-cooled heat exchanger.

Aspect 67 provides the method of any one of Aspects 1-66, wherein the cooled composition has a pressure of 100 psi (689 kPa) to 500 psi (3447 kPa).

Aspect 68 provides the method of any one of Aspects 1-67, wherein the cooled composition has a pressure of 200 psi (1379 kPa) to 300 psi (2068 kPa).

Aspect 69 provides the method of any one of Aspects 1-68, wherein the cooled composition has a temperature of 0° C. to 80° C.

Aspect 70 provides the method of any one of Aspects 1-69, wherein the cooled composition has a temperature of 10° C. to 40° C.

Aspect 71 provides the method of any one of Aspects 1-70, further comprising flowing the cooled composition comprising liquid hydrocarbons to a secondary recovery separator, wherein flowing the cooled composition to the buffer tank comprises flowing a liquid hydrocarbon stream from the secondary recovery separator to the buffer tank.

Aspect 72 provides the method of Aspect 71, wherein the secondary recovery separator comprises a two-phase separator or a three-phase separator.

Aspect 73 provides the method of any one of Aspects 71-72, wherein the secondary recovery separator comprises a heated separator.

Aspect 74 provides the method of any one of Aspects 71-72, wherein the secondary recovery separator comprises an unheated separator.

Aspect 75 provides the method of any one of Aspects 71-74, wherein the secondary recovery separator comprises a separator column.

Aspect 76 provides the method of any one of Aspects 71-75, wherein the secondary recovery separator comprises a level sensor.

Aspect 77 provides the method of any one of Aspects 71-76, wherein the method further comprises flowing a water stream from the secondary recovery separator.

Aspect 78 provides the method of any one of Aspects 71-77, wherein the method further comprises flowing a gaseous hydrocarbon stream from the secondary recovery separator.

Aspect 79 provides the method of any one of Aspects 1-78, wherein the secondary separator comprises a two-phase separator or a three-phase separator.

Aspect 80 provides the method of any one of Aspects 1-79, wherein the secondary separator comprises a heated separator.

Aspect 81 provides the method of any one of Aspects 1-79, wherein the secondary separator comprises an unheated separator.

Aspect 82 provides the method of any one of Aspects 1-81, wherein the secondary separator comprises a heater-treater or a vapor recovery tower (VRT).

Aspect 83 provides the method of any one of Aspects 1-82, wherein the secondary separator comprises a heater-treater.

Aspect 84 provides the method of any one of Aspects 1-83, wherein the secondary separator feeds the tank at a pressure of 5 psi (34 kPa) to 80 psi (552 kPa).

Aspect 85 provides the method of any one of Aspects 1-84, wherein the secondary separator feeds the tank at a pressure of 20 psi (138 kPa) to 50 psi (344 kPa).

Aspect 86 provides the method of any one of Aspects 1-85, wherein the fuel gas composition comprises natural gas liquids.

Aspect 87 provides the method of any one of Aspects 1-86, wherein the fuel gas composition comprises methane, ethane, propane, butane, pentane, hydrocarbons having 6 or more carbon atoms, or a combination thereof.

Aspect 88 provides the method of any one of Aspects 1-87, wherein the fuel gas composition comprises <10% methane, up to 90% ethane, propane, butane, and pentane, and up to 10% hydrocarbons heavier than pentane.

Aspect 89 provides the method of any one of Aspects 1-88, wherein the fuel gas composition is less than or equal to 17 mole % oxygen.

Aspect 90 provides a method of recovering gaseous hydrocarbons from tank headspace as fuel on-site, the method comprising:

flowing a hydrocarbon gas composition from headspace of a tank fed by a heater-treater into a compressor to form a compressed mixture, wherein the heater-treater accepts a crude liquid hydrocarbon input stream from a two-phase separator, wherein the two-phase separator comprises a crude hydrocarbon input stream and comprises an output stream comprising the crude liquid hydrocarbon stream that is inputted to the heater-treater;

flowing the compressed mixture into a cooling unit to cool the compressed mixture, to form a cooled composition comprising liquid hydrocarbons;

flowing the cooled composition to a buffer tank to form a buffered fuel composition;

removing a fuel gas composition from headspace of the buffer tank; and combusting the fuel gas composition as an on-site fuel; or the method comprising:

flowing a hydrocarbon gas composition from headspace of a tank fed by a separator (e.g., a primary separator or a secondary separator) into a compressor to form a compressed mixture, wherein the separator accepts a crude hydrocarbon input stream and outputs a crude liquid hydrocarbon stream to the tank;

flowing the compressed mixture into a cooling unit to cool the compressed mixture, to form a cooled composition comprising liquid hydrocarbons;

flowing the cooled composition to a buffer tank to form a buffered fuel composition;

removing a fuel gas composition from headspace of the buffer tank; and combusting the fuel gas composition as an on-site fuel.

Aspect 91 provides an apparatus for performing the method of any one of Aspects 1-90.

Aspect 92 provides an apparatus for recovering gaseous hydrocarbons from tank headspace as fuel on-site, the apparatus comprising:

a compressor that accepts a hydrocarbon gas composition from headspace of a tank fed by a secondary separator, wherein the secondary separator accepts a crude liquid hydrocarbon input stream from a primary separator, wherein the primary separator comprises a crude hydrocarbon input stream and comprises an output stream that comprises the crude liquid hydrocarbon stream that is inputted to the secondary separator;

a cooling unit that accepts the compressed mixture from the compressor and that forms a cooled composition comprising liquid hydrocarbons;

a flowline from the cooling unit for flowing the cooled composition to a buffer tank to form a buffered fuel composition; and an outlet from headspace of the buffer tank that outputs a fuel gas composition for use as an on-site fuel.

Aspect 93 provides the apparatus of Aspect 92, further comprising a primary recovery separator that accepts the hydrocarbon gas composition from headspace of the tank fed by the secondary separator and that flows the hydrocarbon gas composition from the primary recovery separator to the compressor.

Aspect 94 provides the apparatus of any one of Aspects 92-93, further comprising a secondary recovery separator that accepts the cooled composition comprising the liquid hydrocarbons and that outputs a liquid hydrocarbon stream from the secondary recovery separator to the buffer tank.

Aspect 95 provides the apparatus of any one of Aspects 92-94, wherein the outlet from the headspace of the buffer tank outputs the fuel gas composition to one or more on-site combustors that combust the fuel gas composition.

Aspect 96 provides the apparatus of any one of Aspects 92-95, wherein the outlet from the headspace of the buffer tank outputs the fuel gas composition to heat the primary separator, to heat the secondary separator, as a flare pilot, as gas assist, in an auxiliary internal combustion device for heat or power, or a combination thereof.

Aspect 97 provides the method of any one of Aspects 92-96, wherein the apparatus comprises a processor configured to:

responsive to determining a level transmitter in a lower portion of the buffer tank is immersed in water, cause water to be at least partially drained from the buffer tank;

responsive to determining a level transmitter in an upper portion of the buffer tank is immersed, cause a variable frequency drive on the compressor to run at a lower speed or to shut off;

responsive to determining that a pressure transducer or pressure transmitter in an upper portion of the tank fed by the secondary separator is detecting a pressure above a predetermined pressure threshold, cause the variable frequency drive on the compressor to run at a lower speed or to shut off;

responsive to determining that the pressure transducer or pressure transmitter in the upper portion of the tank fed by the secondary separator is detecting a pressure below a predetermined pressure threshold, cause the variable frequency drive on the compressor to maintain speed or to run at a higher speed;

responsive to determining that a temperature transducer or temperature transmitter measuring temperature of the compressed mixture exiting the compressor is detecting a temperature above a compressed mixture temperature setpoint, cause the variable frequency drive on the compressor to slow or stop; or a combination thereof.

Aspect 98 provides the method or apparatus of any one or any combination of Aspects 1-97 optionally configured such that all elements or options recited are available to use or select from.

What is claimed is:

1. A method of recovering gaseous hydrocarbons from tank headspace as fuel on-site, the method comprising:

flowing a hydrocarbon gas composition from headspace of a tank fed by a secondary separator into a compressor to form a compressed mixture, wherein the secondary separator accepts a crude liquid hydrocarbon input stream from a primary separator, wherein the primary separator comprises a crude hydrocarbon input stream and comprises an output stream comprising the crude liquid hydrocarbon stream that is inputted to the secondary separator;

flowing the compressed mixture into a cooling unit to cool the compressed mixture, to form a cooled composition comprising liquid hydrocarbons;

flowing the cooled composition to a buffer tank to form a buffered fuel composition;

removing a fuel gas composition from headspace of the buffer tank; and combusting the fuel gas composition as an on-site fuel.

2. The method of claim 1, wherein combusting the fuel gas composition as an on-site fuel comprises flowing the fuel gas composition to an on-site fuel system, using the fuel gas composition to heat the primary separator, to heat the secondary separator, as a flare pilot, as gas assist, in an auxiliary internal combustion device for heat or power, or a combination thereof.

3. The method of claim 1, wherein flowing the hydrocarbon gas composition from the headspace of the tank fed by the secondary separator into the compressor comprises flowing the hydrocarbon gas composition from the headspace of the tank fed by the secondary separator to a flame arrestor and flowing the hydrocarbon gas composition from the flame arrestor into the compressor.

4. The method of claim 1, comprising operating the buffer tank at a pressure of 25 psi to 300 psi (172-2068 kPa) and at a temperature that is less than or equal to 20° C. above ambient temperature.

5. The method of claim 1, further comprising monitoring a liquid level in the buffer tank, a temperature in the buffer tank, a pressure in the buffer tank, a pressure in the tank fed by the secondary separator, a temperature of the cooled composition exiting the compressor, or a combination thereof.

6. The method of claim 1, wherein the tank comprises an outlet in an upper portion thereof that is fluidly connected to an emergency pressure release valve.

7. The method of claim 1, wherein the tank comprises an outlet in an upper portion thereof feeding to a back pressure regulator value that is fluidly connected to a flare.

8. The method of claim 1, wherein the tank comprises a fuel gas outlet in an upper portion thereof through which the fuel gas composition is flowed, wherein the fuel gas outlet flows to a regulator valve that controllably flows the fuel gas composition to one or more combustors in which the combusting of the fuel gas composition as an on-site fuel is performed.

9. The method of claim 8, wherein the regulator valve regulates the flow of the fuel gas composition to the one or more combustors at 5 psi to 20 psi (34-138 kPa).

10. The method of claim 8, wherein the fuel gas outlet flows to a solenoid valve in series with the regulator valve, wherein the solenoid valve controllably flows the fuel gas composition to one or more combustors in which the combusting of the fuel gas composition as an on on-site fuel is performed.

11. The method of claim 1, wherein the tank comprises a drain in a lower portion thereof, wherein the drain comprises a drain valve that is fluidly connected to a produced water tank.

12. The method of claim 1, further comprising using a processor configured to monitor a liquid level in the buffer tank, a temperature in the buffer tank, a pressure in the buffer tank, a pressure in the tank fed by the secondary separator, a temperature of the cooled composition exiting the compressor, or a combination thereof.

13. The method of claim 12, wherein the processor is configured to be:

responsive to determining a level transmitter in a lower portion of the buffer tank is immersed in water, cause water to be at least partially drained from the buffer tank;

responsive to determining a level transmitter in an upper portion of the buffer tank is immersed, cause a variable frequency drive on the compressor to run at a lower speed or to shut off;

responsive to determining that a pressure transducer or pressure transmitter in an upper portion of the tank fed by the secondary separator is detecting a pressure above a predetermined pressure threshold, cause the variable frequency drive on the compressor to run at a lower speed or to shut off, responsive to determining that the pressure transducer or pressure transmitter in the upper portion of the tank fed by the secondary separator is detecting a pressure below a predetermined pressure threshold, cause the variable frequency drive on the compressor to maintain speed or to run at a higher speed;

responsive to determining that a temperature transducer or temperature transmitter measuring temperature of the compressed mixture exiting the compressor is detecting a temperature above a compressed mixture temperature setpoint, cause the variable frequency drive on the compressor to slow or stop; or a combination thereof.

14. The method of claim 1, wherein the hydrocarbon gas composition from the headspace of the tank has a pressure of 0.01 psi (0.1 kPa) to 2 psi (14 kPa).

15. The method of claim 1, further comprising flowing the hydrocarbon gas composition from the headspace of the tank to a primary recovery separator, and flowing the hydrocarbon gas composition from the primary recovery separator to the compressor.

16. The method of claim 1, wherein the compressor comprises an oilless compressor, wherein the oilless compressor comprises a crankcase that is free of oil that contacts material being compressed and is free of oil lubrication that requires regular changings.

17. The method of claim 1, wherein the compressed mixture has a pressure of 100 psi (689 kPa) to 500 psi (3447 kPa) and a temperature of 100° C. to 300° C., and wherein the cooled composition has a pressure of 100 psi (689 kPa) to 500 psi (3447 kPa) and a temperature of 0° C. to 80° C.

18. The method of claim 1, wherein the fuel gas composition is less than or equal to 17 mol % oxygen.

19. A method of recovering gaseous hydrocarbons from tank headspace as fuel on-site, the method comprising:

flowing a hydrocarbon gas composition from headspace of a tank fed by a separator into a compressor to form a compressed mixture, wherein the separator accepts a crude hydrocarbon input stream and outputs a crude liquid hydrocarbon stream to the tank;

flowing the compressed mixture into a cooling unit to cool the compressed mixture, to form a cooled composition comprising liquid hydrocarbons;

flowing the cooled composition to a buffer tank to form a buffered fuel composition;

removing a fuel gas composition from headspace of the buffer tank; and combusting the fuel gas composition as an on-site fuel.

20. An apparatus for recovering gaseous hydrocarbons from tank headspace as fuel on-site, the apparatus comprising:

a compressor that accepts a hydrocarbon gas composition from headspace of a tank fed by a secondary separator, wherein the secondary separator accepts a crude liquid hydrocarbon input stream from a primary separator, wherein the primary separator comprises a crude hydrocarbon input stream and comprises an output stream that comprises the crude liquid hydrocarbon stream that is inputted to the secondary separator;

a cooling unit that accepts the compressed mixture from the compressor and that forms a cooled composition comprising liquid hydrocarbons;

a flowline from the cooling unit for flowing the cooled composition to a buffer tank to form a buffered fuel composition; and an outlet from headspace of the buffer tank that outputs a fuel gas composition for use as an on-site fuel.

* * * * *